United States Patent [19]

Kvamsdal

[11] 4,245,748

[45] Jan. 20, 1981

[54] LEAK PROTECTION SYSTEM ON A TANK FOR STORING OR TRANSPORTING LIQUEFIED GAS

[75] Inventor: Rolf Kvamsdal, Moss, Norway

[73] Assignee: Moss Rosenberg Verft A/S, Moss, Norway

[21] Appl. No.: 946,379

[22] Filed: Sep. 27, 1978

[51] Int. Cl.[3] ..... B65D 1/24; B63B 25/16; B65D 90/24; B65D 90/06

[52] U.S. Cl. ..... 220/1 C; 62/45; 114/74 A; 220/21; 220/85 R; 220/901

[58] Field of Search ..... 220/1 C, 21, 85 R, 901; 114/74 A; 62/45

[56] References Cited

U.S. PATENT DOCUMENTS

| | | | |
|---|---|---|---|
| 949,398 | 2/1910 | Monzel | 220/1 C |
| 3,273,741 | 9/1966 | Faunce | 220/21 |
| 3,353,615 | 11/1967 | Nekinken | 220/1 C |
| 3,367,529 | 2/1968 | Welch | 220/21 |
| 3,692,210 | 9/1972 | Schmidt | 220/1 C |
| 3,920,144 | 11/1975 | Callen | 220/1 C |
| 4,079,689 | 3/1978 | Llorente | 114/74 A |
| 4,085,773 | 4/1978 | Tinney | 220/1 C |
| 4,106,424 | 8/1978 | Schuler | 114/74 A |
| 4,145,892 | 3/1979 | Skakunov | 114/74 A |

*Primary Examiner*—George E. Lowrance

*Attorney, Agent, or Firm*—Harold L. Stults; Pasquale A. Razzano

[57] ABSTRACT

A leak protection system on a tank for storing or transporting liquefied gas, having leak collection means which open out above a catch basin placed beneath the tank. The catch basin is of sufficiently large dimensions to permit the gradual evaporation of the leaked material, and is subdivided into a plurality of cells.

4 Claims, 11 Drawing Figures

Figure 3:
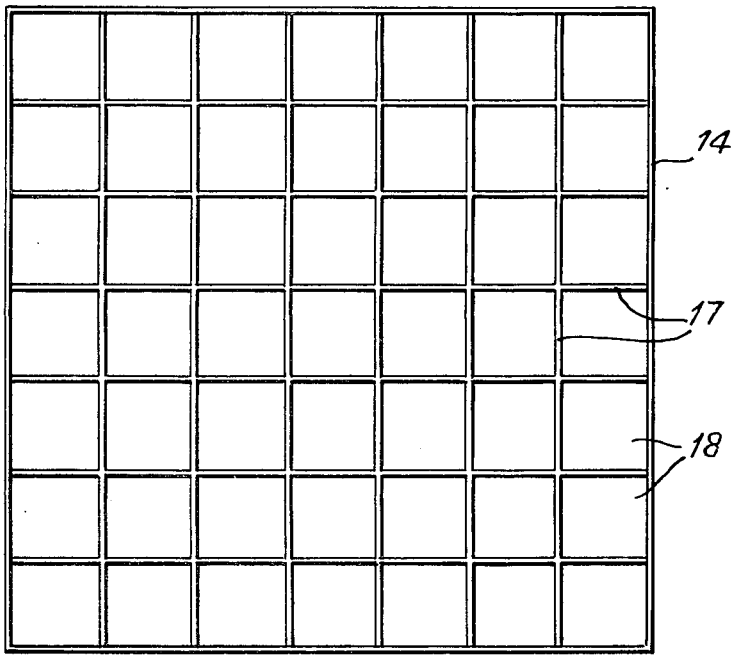

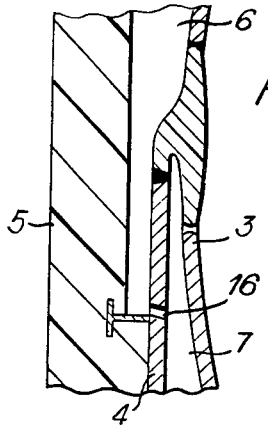
Fig. 2.
Fig. 1.
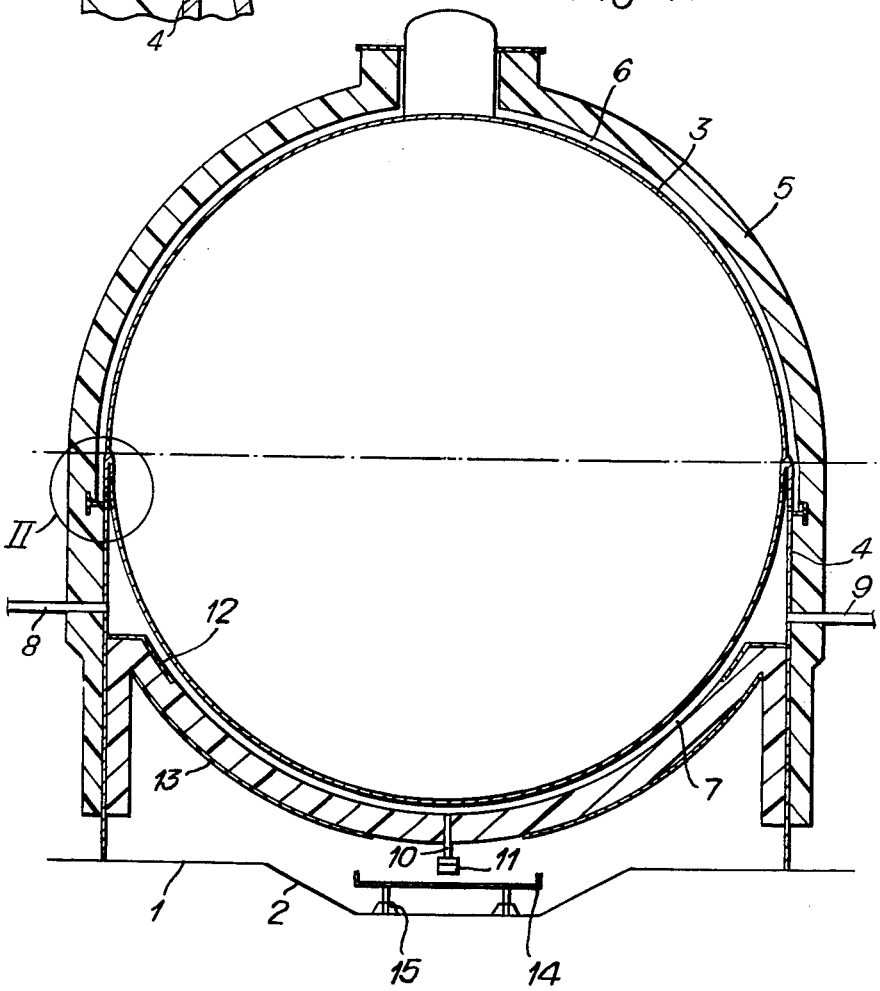

LEAK PROTECTION SYSTEM ON A TANK FOR STORING OR TRANSPORTING LIQUEFIED GAS

The invention pertains to a leak protection system on a tank for storing or transporting liquefied gas, comprising means for collecting leakage from the tank in a sump beneath the tank.

In the known spherical tanks used today for storing or transporting LNG, for example, provisions have been made to collect and carry off lesser leakages of liquefied gas from the tank. This is especially important when the tank is located on board a vessel, for example, a ship or barge, because the liquefied gas must be prevented from contacting the hull itself, which would in that case become cooled to a dangerous degree. An important part of the small leak protection system for such tanks at present is a partial insulation of the region beneath the tank, e.g., the inner bottom of a spherical tank ship. The insulation has a fluid-proof covering, and in addition a system of drainage pumps is installed which can either pump out water that has leaked in or liquefied gas that has escaped from the tanks.

The purpose of the invention is to simplify the small leak protection system on such tanks, such that one can avoid the system of drainage pumps for LNG and the insulation in the sump under the tank.

In accordance with the invention, therefore, a catch basin to which any leaked cargo is conveyed is provided beneath the tank, the basin being of sufficiently large dimensions to permit the leaked cargo to evaporate gradually. With such an arrangement, the system of pumps can be limited only to pumps for draining water, and insulation of the sump under the tank is no longer necessary. Substantial simplification and concomitant savings are thus obtained, not the least for normal operation of, e.g., a spherical tank ship. A particular advantage is that the inner bottom of the ship is not exposed to the risk of hidden corrosion.

The size of the catch basin is determined on the basis of calculations of the small leaks that would occur with one or more smaller breaks in the tank wall. For leakages from a spherical tank having a diameter of approximately 30 meters, one can calculate today that the largest amount of LNG that could be evaporated would be about 0.05 $m^3$/hour, or 25 kg/hour; assuming that a catch basin would be able to absorb 850 kcal per $m^2$ and per hour, sufficient to evaporate 7 kg of LNG per $m^2$ and per hour, therefore, the catch basin in this case should have a surface area of about 4 $m^2$.

If the catch basin is made of aluminum, radiant heat transfer will be restricted, so that on board a ship it would not be necessary to have any sort of insulation between the catch basin and the inner bottom of the ship in order to protect the inner bottom. This naturally results in a valuable simplification with respect to inspection and maintenance.

The catch basin is preferably subdivided into several cells. One thereby ensures that the largest possible area of the catch basin will be utilized for evaporation when the catch basin is installed on board a ship that is moving in the sea. If leaked LNG is conveyed to the middle of such a basin, at least half of the basin will be wetted if the ship has a certain trim or list.

Additional measures can also be taken to ensure that most of the basin area becomes wetted, taking into account the ship's orientation in the sea with respect to its trim and/or list. The catch basin can then comprise an upper section and a lower section; the leak collection means discharge into the upper section, and drainage ducts run from the bottom of the upper section to open out above the lower section. These ducts preferably open out above the lower section at locations which are diametrically opposite their points of connection with the upper section. The upper section of the catch basin, seen in plan view, is preferably in the shape of a cross, and is provided with partitioning walls which are lower than the outer walls, such that the upper portion is thereby subdivided into one central cell and one cell in each arm of the cross. Extending down from each cell in the arms of the cross is a tube which opens out above the lower section of the catch basin. Preferably, the lower section is also subdivided into cells by means of dividing walls, these walls being of disparate heights but all being lower than the outer walls, and where the partitions between at least some of the cells along the outer walls, above which said tubes discharge, are lower than those separating the other cells.

The embodiment described above is especially favourable for obtaining the best possible distribution of the leaked material over the area of the catch basin.

Preferably, between the leak collection means and the catch basin, a membrane is arranged which normally blocks the passage of leakage to the catch basin in order to prevent undesired flows of the atmosphere in the space around the tank, but which is adapted to rupture at low temperature. Thus, when liquid gas reaches the membrane, it will burst as soon as it has become sufficiently cooled, and the leaked liquefied gas can then pass into the catch basin and vaporize.

As mentioned above, the catch basin is preferably made of aluminum in order to reduce the radiation of heat to the surroundings.

The leak collection means, in a manner known per se, can be formed by channels between the tank wall and an exterior tank insulation, or by arranging a clearance between the insulation and the tank wall. The tank insulation, according to the invention, is made to be fluid-proof in the lower region of the tank, permitting any leaked material to be collected safely and conveyed to the catch basin.

The invention will be elucidated further with reference to the drawings, where

Figure 4:
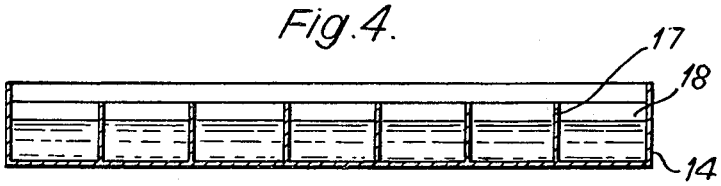
Figure 5:
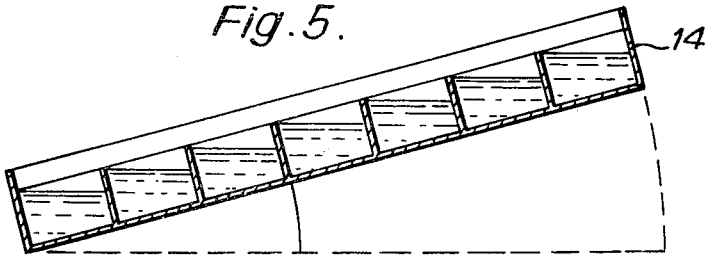
Figure 6:
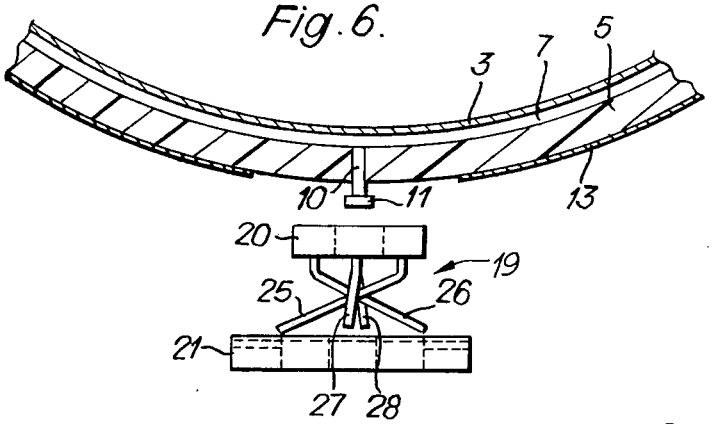
Figure 7:
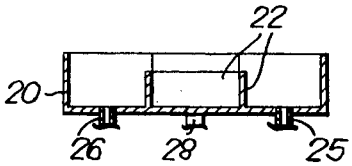
Figure 8:
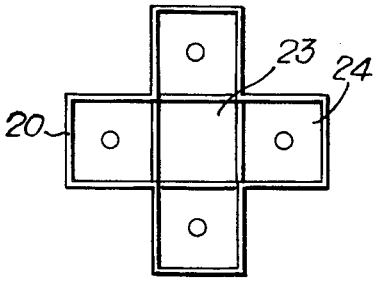
Figure 9:
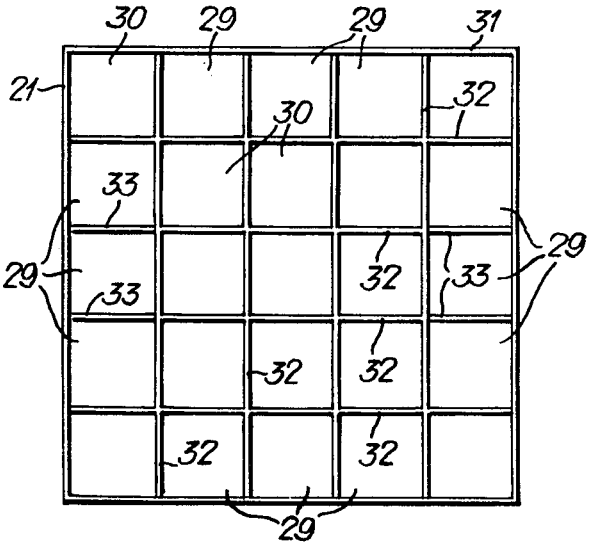
Figure 10:
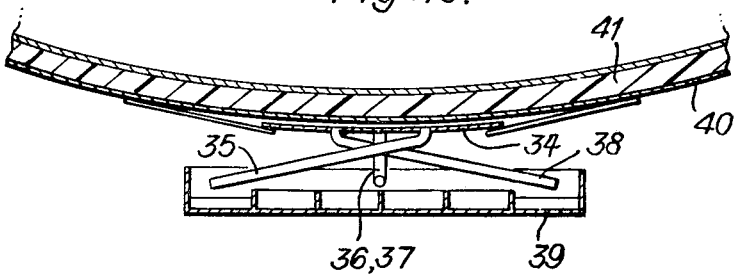
Figure 11:
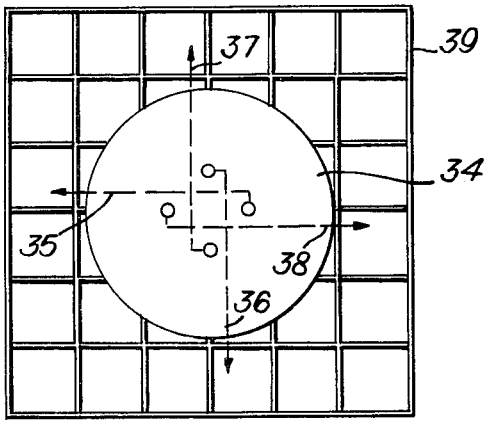

FIG. 1 is a cross section through an insulated spherical tank on board a ship, having the leak protection system of the invention, FIG. 2 is an enlarged detail drawing of the area within the circle II on FIG. 1, FIG. 3 is a plan view of the catch basin which can be used according to the invention, FIG. 4 is a schematic cross section through the catch basin of FIG. 3, FIG. 5 is a schematic cross section as in FIG. 4, but with the catch basin inclined as it would be, for example, with a rolling movement of the ship, FIG. 6 shows the lower portion of the spherical tank of FIG. 1 and a modified embodiment of the catch basin, FIG. 7 is an enlarged cross section through the upper section of the catch basin of FIG. 6, FIG. 8 is an enlarged plan view of the upper section of the catch basin of FIG. 6, on the same scale as FIG. 7, FIG. 9 is a plan view of the lower section of the catch basin of FIG. 6, on the same scale as FIG. 6, FIG. 10 shows another modified embodiment of the catch basin, and FIG. 11 is a schematic plan view of the embodiment of FIG. 10.

On FIG. 1, an inner bottom of a ship is designated 1. The shape of the ship bottom is such that a depression or sump 2 is formed. The sump is located beneath a spherical tank 3 which is supported by a cylindrical skirt 4. The cylindrical skirt 4 extends from the equator of the spherical tank and down to the inner bottom 1 and is welded to the spherical tank and to the inner bottom. The spherical tank is insulated and the insulation material is designated 5. The insulation extends for a distance down along the skirt 4, as can be seen on FIG. 1.

Channels 6 and 7 are disposed between the insulation 5 and the tank 3, or in some other way, e.g., by providing clearance, the possibility is provided for leaked gas to flow down between the tank and the insulation in order to prevent an intolerably high over-pressure between the tank and insulation. Through a feed pipe 8, nitrogen can be supplied to the region between the insulation and the tank in order to have an inert atmosphere. The nitrogen is exhausted through an outlet pipe 9.

Any leaked cargo will collect between the insulation 5 and the tank 3 and run down to a drain 10, which is normally closed by a membrane 11 which, however, will rupture if exposed to low temperature. The insulation 5 is made to be fluid-proof in the lower region of the spherical tank, being provided with a fluid-proof covering 12, 13 both on the inner side toward the tank and on the outer side toward the space beneath the tank. On the outer side, the covering 13 extends in to an area above a catch basin provided below the drainage outlet 10. The catch basin is supported on insulated supports 15 resting on the inner bottom of the ship.

To ensure the collection of any leakage, the upper collection region 6 on the tank is connected with the lower collection region 7 by means of a plurality of openings 16 in the skirt 4 (FIG. 2). The catch basin 14 can, for example, be made as illustrated on FIGS. 3 and 4. In this embodiment, the catch basin is a square, upwardly-open container which is subdivided by means of partitions 17 into smaller cells 18. FIGS. 4 and 5, respectively, show the distribution of liquid in the catch basin in a horizontal position and in an inclined position, e.g., when the ship trims or lists. When the drain 10 with its membrane 11 is centrally positioned over a catch basin of this type, at least half of the catch basin will be wetted.

An embodiment of the catch basin which ensures that most of the catch basin area will be wetted is shown on FIGS. 6–9. The same reference numbers as before are used to designate the tank 1, the insulation 5 and the collection channel 7, as seen on FIG. 6. Also illustrated are the fluid-proof covering 13 and the drainage outlet 10 with its associated membrane 11.

Arranged beneath the tank in this case is a catch basin 19, which consists of an upper section 20 and a lower section 21. As can be seen on FIGS. 7 and 8, the upper section 20 is in the form of a cross and provided with internal partitions 22 to form a central cell 23 and four cells 24, one in each of the arms of the cross. From each cell 24, respective tubes 25, 26, 27 and 28 extend down to open out over the lower section 21. The tubes, as seen on FIG. 6, are led in a criss-cross fashion, such that the respective tubes open out over the lower section of the basin at locations that are diametrically opposite their points of connection to the upper section. The partitions 22, as can be seen on FIGS. 7 and 8, are lower in height than the outer walls of the upper section 20.

The lower section 21 of the catch basin is subdivided by means of partitions into smaller cells 29 and 30. The partitioning walls are of different heights, and all of the partitioning walls are lower than the outer walls 31. The partitions 32 are the same height, while the partitions 33 are not as high as the walls 32. Each of the tubes 25–28 opens out into the middle cell of its respective lower cell group 29. The partitions that are lower in height are used in order to facilitate a distribution of fluid across the width when the catch basin is inclined. The criss-cross formation of the tubes helps one to obtain adequate distribution of the leakage, which passes from the drain 10 into the upper section 20 of the catch basin. At positions inclined either to one side or the other, one will be assured at all times that the leakage will be conveyed to the opposite side of the lower section of the catch basin, such that one obtains a good distribution no matter what the orientation of the basin happens to be.

If a leak occurs, e.g., in the upper half of the tank 3, the leaked material will run down the outside of the tank, between the tank and the insulation, through the openings 16 in the skirt (FIG. 2) into the area between the tank and insulation in the lower half of the tank, and down to the bottom to the membrane 11, which will rupture upon exposure to the low temperature. The leaked fluid can then flow down into the catch basin and vaporize.

Illustrated in FIGS. 10 and 11 is an example of an embodiment in which the upper section of the catch basin, the distributor basin, is a low, round basin 34 having four drainage tubes 35, 36, 37 and 38, each of which is led to an opposite side of the lower section, i.e., to the actual evaporator basin 39. In this case the lower portion of the covering 40 on the insulation 41 is utilized as the distributor basin. In each of the tubes 35–38, a cold-embrittled membrane is arranged (not shown). The evaporator basin 39 is made like the basin 21 in FIGS. 6 and 9.

In this embodiment, to ensure that the insulation 41 on the lower half of the tank does not collapse and fail, there are in practice arranged a plurality of steel bands which extend from the equator of the spherical tank, from the inner side of the skirt and down to the lower pole region, where they are attached to a round plate or latitudinal disk whose configuration follows that of the tank surface. This disk can serve as the distributor basin. The embodiment illustrated in FIGS. 10 and 11 provides a structure of extremely low height.

In the above description, only the leak collection means themselves have been described. In practice, auxiliary equipment such as gas detection equipment, etc., will also be used.

The invention is naturally not limited to use on tanks containing LNG. The invention can be utilized on any tank filled with a liquefied gas.

To exhaust the vapor that forms following a leakage, the same outlet 9 (FIG. 1) as for the nitrogen gas can be used, or separate venting means could optionally be provided.

Having described my invention, I claim:

1. A leak protection system for a tank for storing or transporting liquified gas which comprises, the combination of, means for collecting the liquified gas which leaks from the tank, a catch basin positioned beneath the tank and of sufficiently large dimensions to permit gradual evaporation of the leaked material, said catch basin comprising an upper section and a lower section and positioned whereby said collection means discharges the liquified gas into said upper section, a plurality of ducts extending from the bottom of said upper section to above said lower section and providing flow paths for the liquified gas from said upper section to said lower section, each of said ducts extending between locations at said upper and lower sections which are diametrically opposite with respect to the vertical center axis of said catch basin, said upper section being in the shape of a cross and subdivided by means of partitions which are lower than said outer walls and form a central cell and a cell in each arm of the cross, and wherein a duct extends downwardly from each arm of the cross and opens out above said lower section of the basin.

2. The construction as described in claim 1, wherein each of said upper and lower sections comprises a tray having side walls and having partitions of lower height than said side walls.

3. The construction as described in claim 1, wherein said upper section comprises a tray centrally mounted beneath said tank, said lower section having a peripheral side wall and a plurality of partitions of lesser height than said side walls and forming said cells.

4. In combination with a tank for storing and/or transporting liquified gas, a small leak protection system comprising collection means and storage means for said liquified gas, said storage means being positioned beneath said tank and at a lower level than said collection means and means comprising an upper section and a lower section, each of said sections having partition means which divides it into a plurality of cells, said partition means being of such height as to permit the flow of liquid between said cells without overflowing the sides of the section, said upper section being in the form of a cross, and duct means extending from the bottom of said upper section toward and discharging into said lower section, said duct means comprising a plurality of ducts each extending from one side of the vertical center line of said upper section to the opposite side of said lower section relative to said axis, with there being one of said ducts connected to each arm of said cross.

* * * * *